US006629870B2

(12) United States Patent
Robinson

(10) Patent No.: US 6,629,870 B2
(45) Date of Patent: Oct. 7, 2003

(54) BUBBLE BLOWER

(75) Inventor: Dean F. Robinson, Dighton, MA (US)

(73) Assignee: Little Kids, Inc., Providence, RI (US)

( * ) Notice: Subject to any disclaimer, the term of this patent is extended or adjusted under 35 U.S.C. 154(b) by 0 days.

(21) Appl. No.: 09/808,625

(22) Filed: Mar. 14, 2001

(65) Prior Publication Data

US 2002/0132551 A1 Sep. 19, 2002

(51) Int. Cl.[7] ..... A63H 33/28
(52) U.S. Cl. ..... 446/16
(58) Field of Search ..... 446/15, 16, 486, 446/310, 311, 18, 21, 73, 74; D21/401, 402

(56) References Cited

U.S. PATENT DOCUMENTS 608,794 A * 8/1898 Quinn ..... 446/310
1,921,933 A 8/1933 Levenberg
1,937,084 A 11/1933 Janssen
2,612,313 A 9/1952 Williamson
4,169,481 A 10/1979 Hultberg
5,057,005 A * 10/1991 Kwok ..... 431/253
5,120,263 A * 6/1992 Ierfino et al. ..... 446/486

FOREIGN PATENT DOCUMENTS

GB 2244219 A * 11/1991 ..... A63H/13/16

* cited by examiner

*Primary Examiner*—Jacob K. Ackun
*Assistant Examiner*—Bena B. Miller
(74) *Attorney, Agent, or Firm*—Richard D. Zimmerman

(57) ABSTRACT

A bubble blower having a container enclosure with an opening, one or more walls extending from the opening into the container, a moveable closure member which is biased against the wall by a biasing member such as a spring. The volume of solution, when the container is filled to the bottom of the wall, is grater than one-half of the volume of the container. A bubble wand having a handle in a different plane from the bubble forming member permits more efficient blowing of large bubbles.

19 Claims, 8 Drawing Sheets

BUBBLE BLOWER

FIELD OF INVENTION

This present invention relates generally to spill resistant bubble blowing devices.

DESCRIPTION OF KNOWN ART

Spill resistant containers for holding soap-blowing solution are known. These known containers generally require that the contained solution be no more than one-half the volume of the container, or employ a resilient flap to cover an opening into the bubble solution container. Also known are smokers' ash receptacles using spring biased closure members operated by a push rod. The push rod or other features project into or above the opening of the container, preventing their use as a bubble solution container. Known ash receptacles do not function to permit removal of a solution from the receptacle in a way suitable for blowing bubbles.

SUMMARY OF INVENTION

A bubble blower having features of the present invention comprises a container having an opening, one or more walls projecting from the opening into the container, a closure member located inside the container, and a biasing member that biases the closure member against the walls to resist spillage of solution in the container. The volume of solution, when the container is filled to the bottom of the wall, is greater than one-half of the volume of the container. A bubble wand having a handle in a different plan from the bubble forming.

DESCRIPTION OF THE PREFERRED EMBODIMENTS

Figure 1:
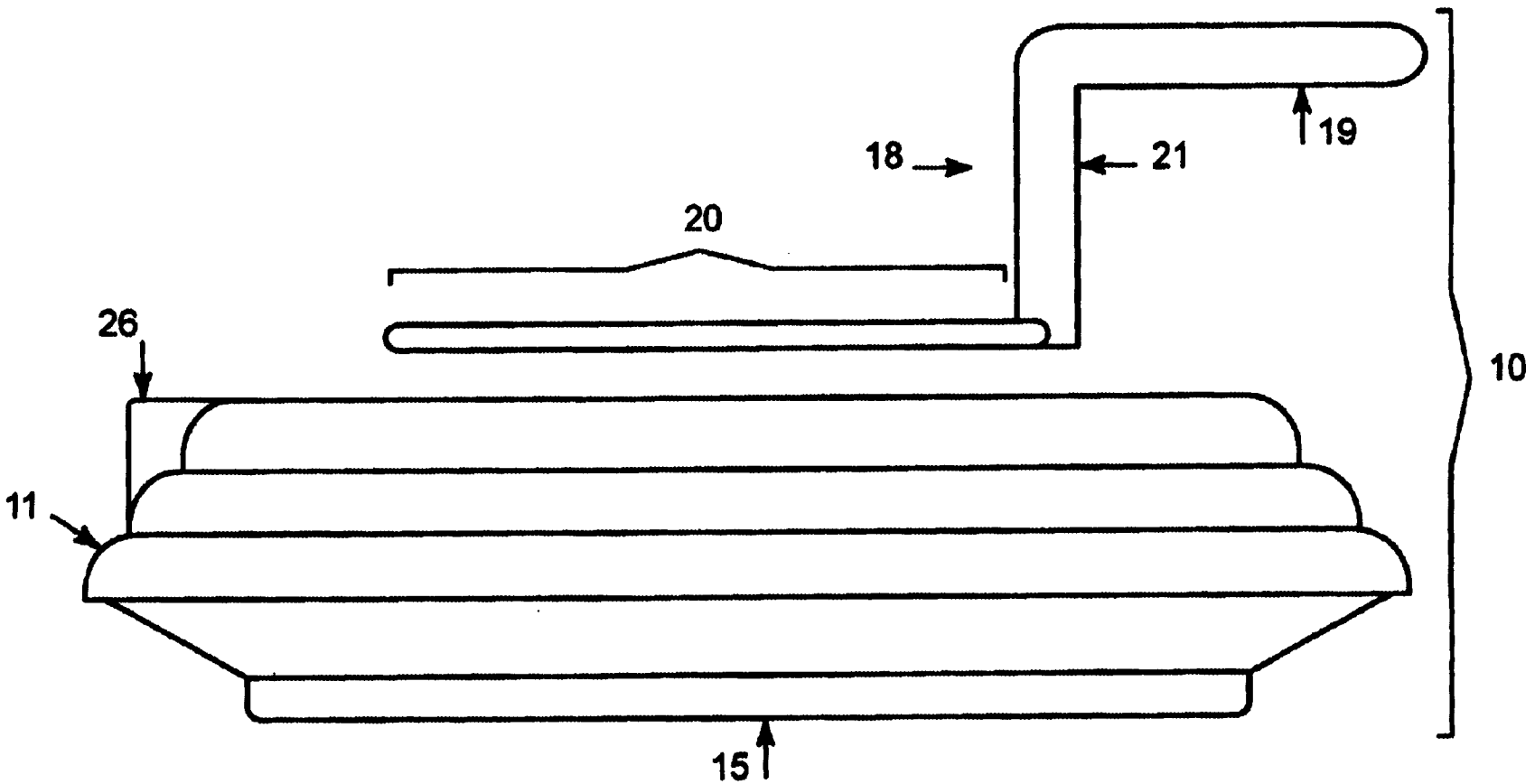
FIG. 1 is a perspective view of a bubble solution container.
Figure 2:
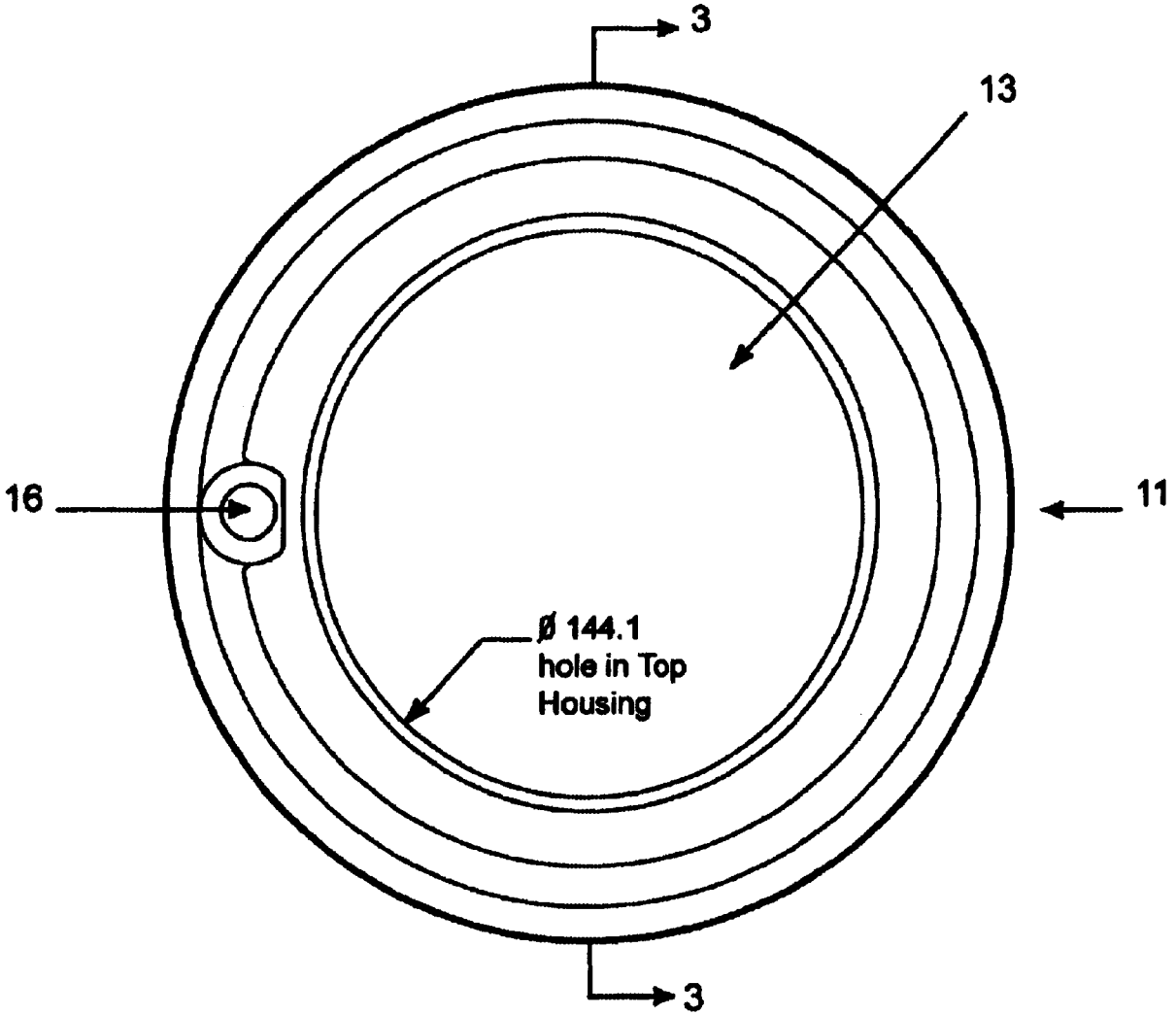
FIG. 2 is a top plan view of a bubble solution container.
Figure 3:
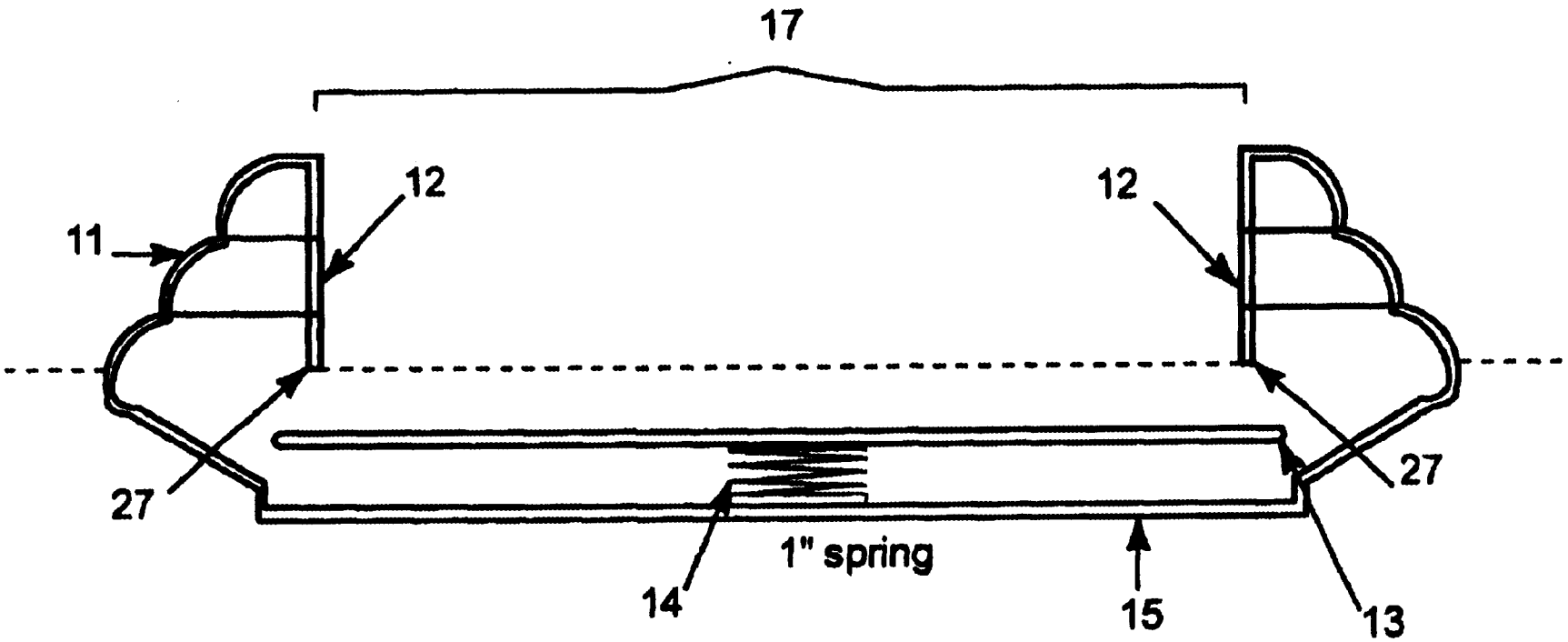
FIG. 3 is a sectional view of a bubble solution container along the 3—3 axis in FIG. 2.

The bubble blower 10 has a container 11 and a wand 18. As shown in FIGS. 1, 2 & 3, the container 11 contains an opening 17, a base 15, and one or more walls 12 extend from the opening into the container. A closure member 13, located inside the container (11), is biased toward the wall (12) by a biasing member 14.

The enclosure generally will be molded plastic. In this embodiment the container (11) and opening (17) are annular, and the diameter of the opening is greater than the one-half the diameter of the container. This permits very large wands to be dipped into the solution, while maintaining spill-resistence with the closure member (13).

Figure 4:
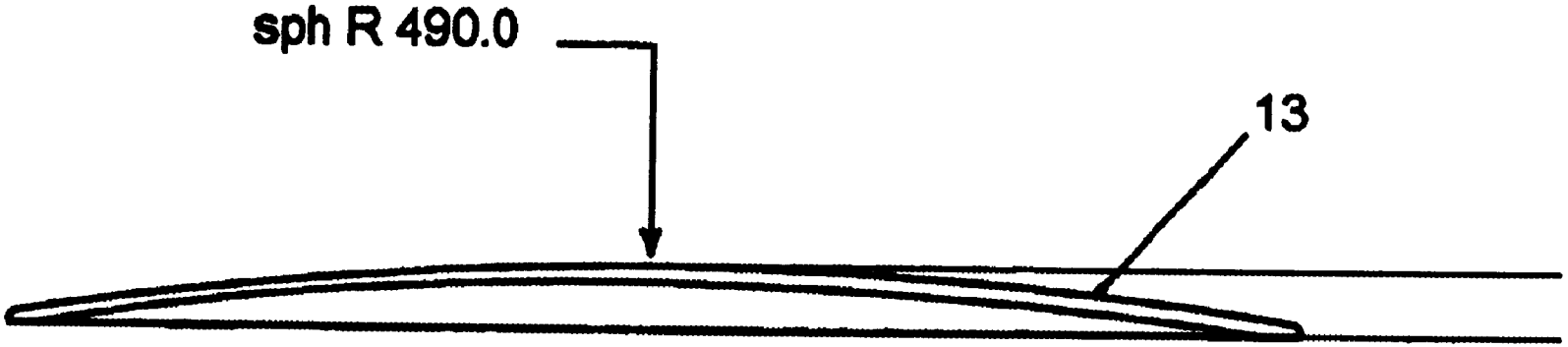
FIG. 4 is a sectional view of a closure member along the 4—4 axis in FIG.2.
Figure 6:
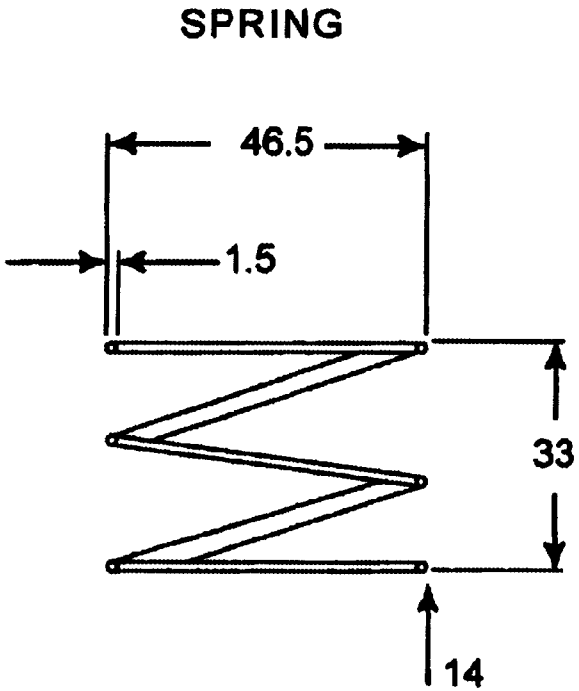
FIG. 6 is a side view of a biasing member.
Figure 5A:
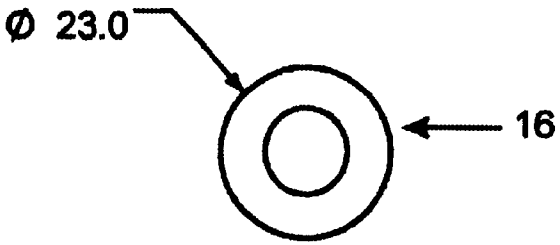
FIG. 5A is a top view of a plug.
Figure 5B:
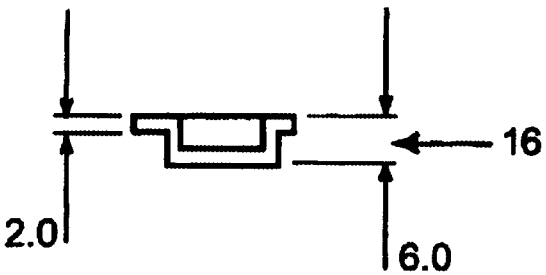
FIG. 5B is a side view of a plug.
Figure 5C:
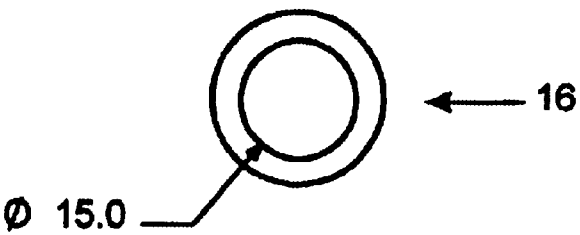
FIG. 5C is a bottom view of a plug.

The closure member (13) is sized to fit the walls (12). In this embodiment, the wall and closure member are annular, and the closure member is a thin plastic disk. As shown in FIG. 4, the closure member may have a slight arc to facilitate run off of the bubble solution. An arc also improves formation of the membrane across the bubble wand, since it makes the membrane of bubble solution less likely to break as the wand is removed from the solution. The closure member is sized to fit in the container so that the closure member can move easily on the axis perpendicular to the base, but is restricted in its movement in planes parallel to the base. This positions the closure member (13) so that the junction between the closure member and wall bottom 27 is resistant to the flow of bubble solution when the closure member is biased toward the wall bottom. Restricting the positioning of the closure member also assists in preventing undesirable movement of the biasing member, whether the biasing member is friction fit or more permanently affixed to the closure member.

The user presses the closure member away from the wall, preferably with a bubble wand. This allows bubble solution in the enclosure to flow over the closure member and coat the bubble wand. As the bubble wand is withdrawn, the biasing member (14) biases the closure member against the wall bottom (27), making the container spill resistant. The biasing member in this embodiment is a spring, but other well-known alternatives could substitute. A retaining member, such as a strap, physical attachment or short wall rising from the base (15) of the container (11) or from the closure member may be necessary to keep the biasing member in place.

Figure 7:
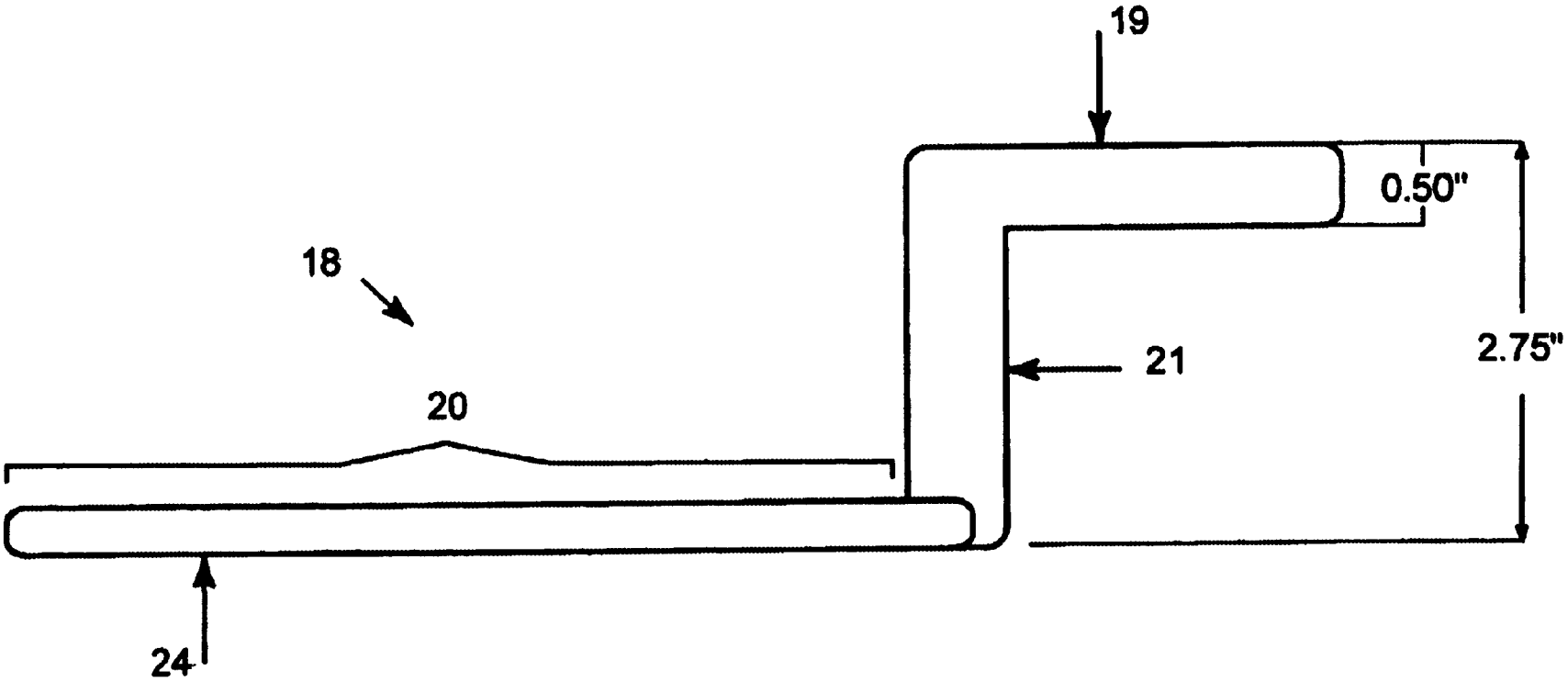
FIG. 7 is a side view of a wand.
Figure 8:
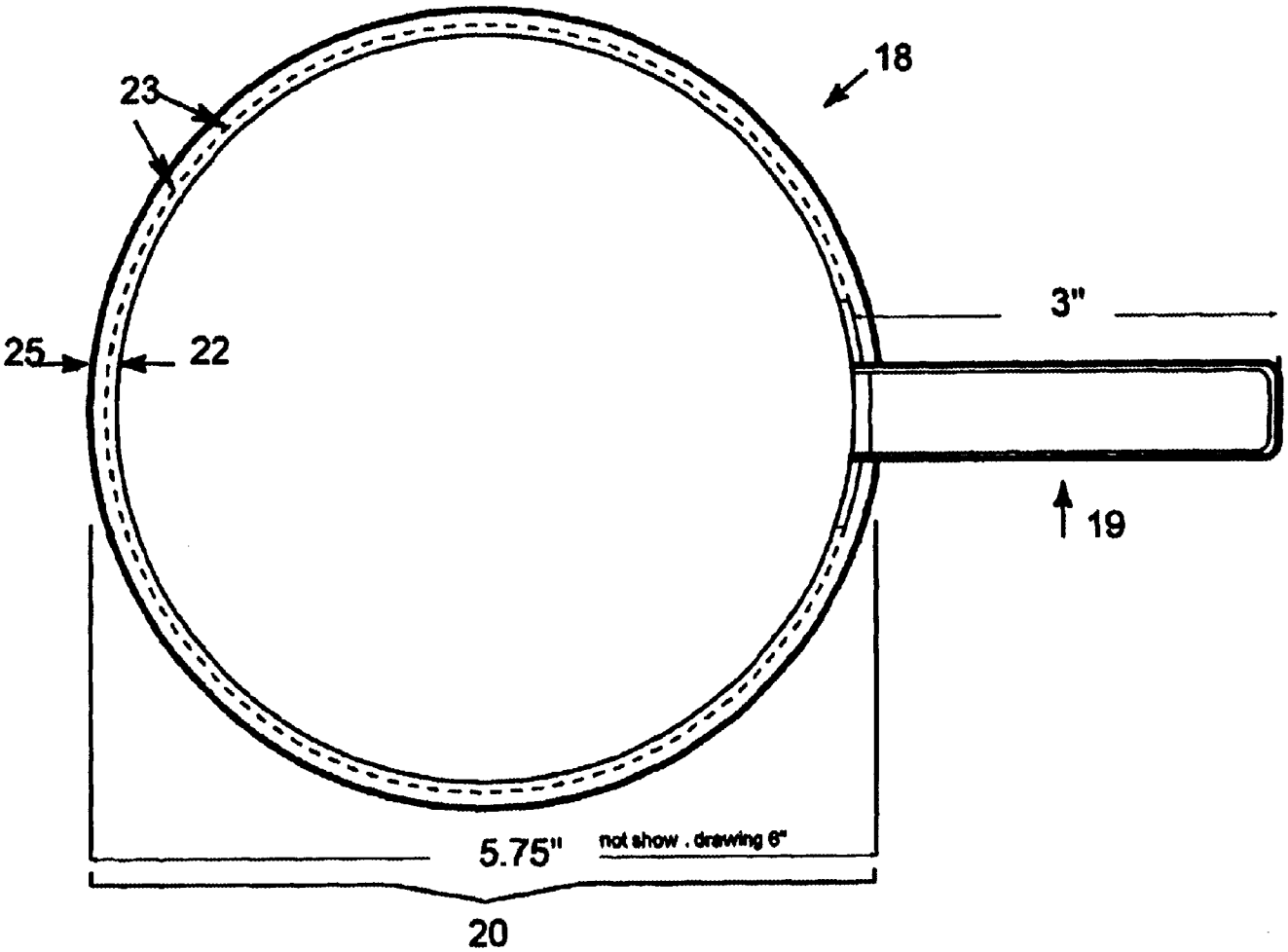
FIG. 8 is a top view of a wand.
Figure 9:
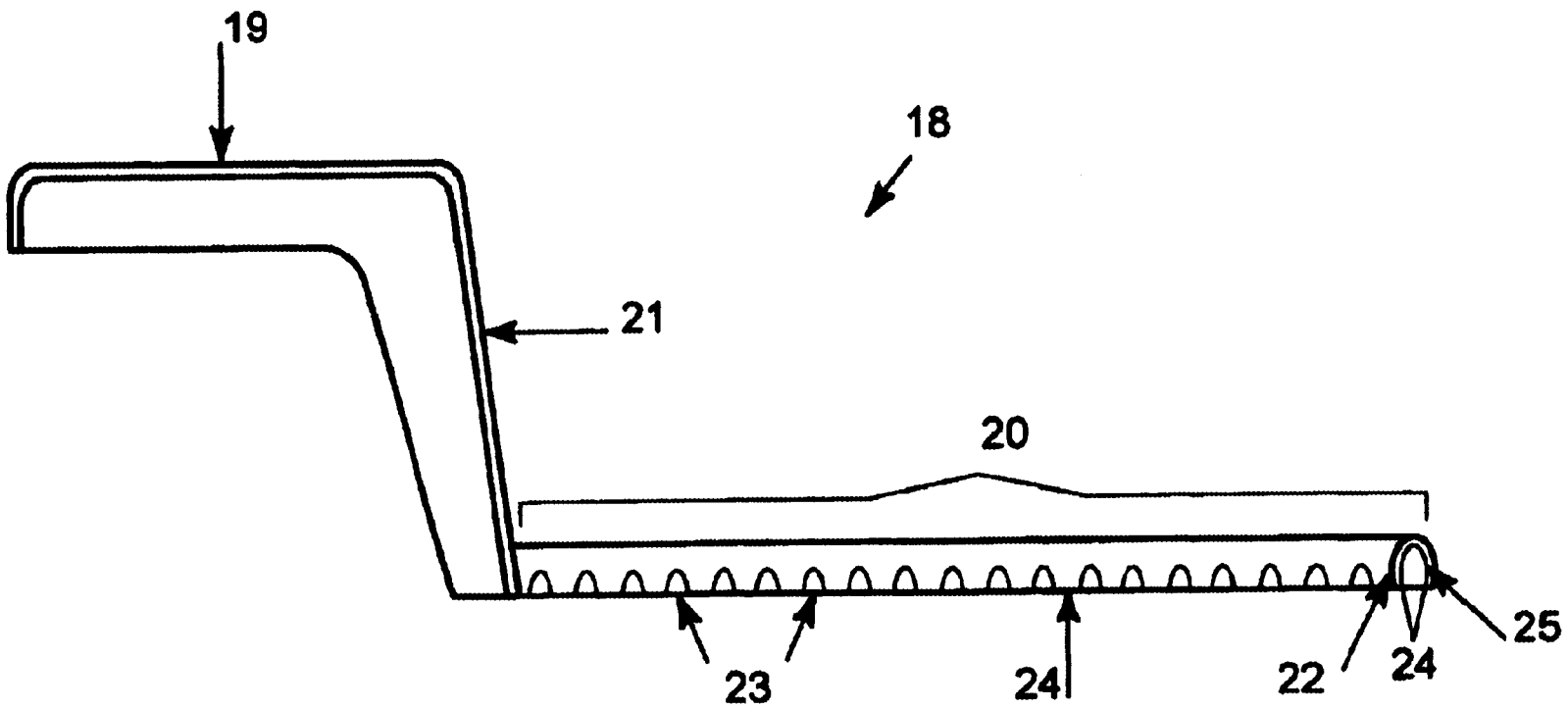
FIG. 9 is a sectional view of a wand along the 9—9 axis in FIG. 7

Bubble blowing is enhanced by using a wand 18 having a handle 19 and a bubble forming member 20 in different planes. As shown in FIG. 7, this permits the user to press the closure member away from the wall, and simultaneously coat the wand bubble forming member (20) effectively, since the bubble forming member can be positioned against the closure member in approximately the same plane as the bubble closure member. The handle (19) and bubble forming member (20) can be separated by a spacer 21, as shown in FIG. 7, or the handle can be attached directly to the bubble forming member at an angle.

In this embodiment, the bubble forming member 20 is annular, but generally should be shaped to match the opening to maximize bubble size. In this embodiment, the bubble forming member has an inner member 22 having a series of openings 23 on the contact surfaces 24 of the bubble forming member (20). The inner member is connected to an outer member 25, which lacks openings. This permits bubble solution to flow through the inner member, but not the outer member, which allows more bubble solution to adhere to the bubble forming member, and results improved bubble membrane formation.

The container may have a drain hole 26, which can be covered with a removable plug 16 to permit easy draining and filling.

I claim:

1. A bubble blower comprising a container having a base, an opening, one or more walls projecting from the opening into the container, a wall bottom on each such wall, a moveable closure member located inside the container, and a biasing member that biases the closure member toward each wall bottom, and a wand which has a handle and a bubble forming forming member in different planes, the bubble forming member being sized to permit removal of liquid through the opening.

2. The bubble blower of claim 1 having a wand which has a handle and a bubble forming member in different planes.

3. The bubble blower of claim 1 in which the biasing member is a spring.

4. The bubble blower of claim 1 in which the closure member is a disk.

5. The bubble blower of claim 1 in which the closure member is annular and the diameter of which is more than one-half of width of the container.

6. The bubble blower of claim 1 in which each such wall has a bottom, and the volume of the container from its base to the bottom of the walls, is more than one-half of the entire volume of the container.

7. A bubble blower comprising a container having a base, an opening, one or more walls projecting from the opening into the container, a moveable closure member located inside the container, a biasing member that biases the closure member toward the wall, and a bubble wand which has a handle and a bubble forming member in different planes, the bubble forming member being sized to permit removal of liquid through the opening.

8. The bubble blower of claim 7 in which each such wall has a bottom, and the volume of the container from its base to the bottom of the walls, is more than one-half of the entire volume of the container.

9. The bubble blower of claim 7 in which the opening, closure member and wand are annular.

10. The bubble blower of claim 7 in which the handle and bubble forming member are separated by a spacer.

11. The bubble blower of claim 7 in which the closure member has an arc.

12. The bubble blower of claim 7 in which the bubble forming member has a contact surface, an inner member and an outer member, and a plurality of openings in the inner member adjacent to the contact surface.

13. A bubble blower comprising a container having a base, an opening, one or more walls projecting from the opening into the container, a moveable closure member located inside the container, and a biasing member that biases the closure member toward the wall and having a wand which has a bubble forming member, so that the wand may be pressed against the closure member, moving the closure member away from the wall bottom, allowing bubble solution in the container to flow over the closure member and coat the bubble wand, and, as the wand is withdrawn, the biasing member biases the closure member against the wall bottom, making the container spill resistant, and having a wand which has a bubble forming member.

14. The bubble blower of claim 13 having a wand which has a bubble forming member.

15. The bubble blower of claim 12 having a wand which has a bubble forming member with a contact surface, an inner member and an outer member, and a plurality of openings in the inner member adjacent to the contact surface.

16. The bubble blower of claim 13 in which the biasing member is a spring.

17. The bubble blower of claim 13 in which the closure member is a disk having an arc.

18. The bubble blower of claim 13 in which the closure member is annular and diameter of which is more than one-half of the width of the container.

19. The bubble blower of claim 13 in which the volume of the container from its base to the bottom of the walls is more than one-half of the entire volume of the container.

* * * * *